US012571267B1

(12) United States Patent
Hashmi

(10) Patent No.: US 12,571,267 B1
(45) Date of Patent: Mar. 10, 2026

(54) DOWNHOLE CENTRALIZER TOOL

(71) Applicant: SAUDI ARABIAN OIL COMPANY, Dhahran (SA)

(72) Inventor: Ahmad Atef Hashmi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 19/062,552

(22) Filed: Feb. 25, 2025

(51) Int. Cl.
*E21B 17/10* (2006.01)

(52) U.S. Cl.
CPC ..... *E21B 17/1078* (2013.01)

(58) Field of Classification Search
CPC ..... E21B 17/1057; E21B 17/1064; E21B 17/1078
See application file for complete search history.

(56) References Cited

U.S. PATENT DOCUMENTS 3,762,828 A * 10/1973 Faber ..... B23D 77/042 29/90.01
4,372,622 A * 2/1983 Cheek ..... F16C 29/0678 175/325.3
4,958,692 A * 9/1990 Anderson ..... E21B 4/003 175/323
5,715,898 A * 2/1998 Anderson ..... E21B 17/1057 175/323
9,399,894 B2 7/2016 Perry
9,963,942 B2 5/2018 Eidem et al.
2002/0020526 A1* 2/2002 Male ..... E21B 17/1057 175/325.1
2003/0159834 A1* 8/2003 Kirk ..... E21B 17/1057 175/325.3
2013/0333949 A1 12/2013 Simpson

* cited by examiner

*Primary Examiner* — David Carroll
(74) *Attorney, Agent, or Firm* — Vorys, Sater, Seymour and Pease LLP

(57) ABSTRACT

A centralizer tool may include a tool body providing opposing first and second ends and defining a central bore extending between the first and second ends. A plurality of veins may be provided on an outer surface of the tool body and extending at least partially between the first and second ends. An interior channel is defined in at least one of the plurality of veins and extending between opposing first and second fluid ends of the at least one of the plurality of veins. At least one roller ball may be dynamically coupled to and extending radially outward and past an outer surface of the at least one of the plurality of veins, wherein a wellbore fluid circulating through the interior channel is fluidly communicable with the at least one roller ball.

19 Claims, 5 Drawing Sheets

DOWNHOLE CENTRALIZER TOOL

FIELD OF THE DISCLOSURE

The present disclosure relates generally to drilling operations and downhole assemblies and, more particularly, to methods and systems for centering and reducing friction of downhole assemblies.

BACKGROUND OF THE DISCLOSURE

Oil and gas wellbores are commonly drilled with a drill bit connected to the end of a string of drill pipe comprising a plurality of tubulars coupled end-to-end and commonly referred to as "drill string". Rotating the drill bit while it is engaged with the earth grinds and cuts into the underlying rock formations to penetrate the earth and thereby create and extend the length of a wellbore. Drilling fluid or "mud" is pumped down the drill string and discharged from the drill bit via one or more nozzles included in the drill bit. The discharged drilling fluid cools the drill bit while also circulating the drill cuttings back to the surface location within the annulus defined between the wellbore and the drill string.

In some applications, the drill bit is rotated by rotating the entire drill string from a drilling rig positioned at the earth's surface. In such applications, the rotating drill pipe can sometimes become stuck within the wellbore either differentially or mechanically, or due to well formation lithology. In such cases, it can require a substantial amount of time and cost to free the stuck drill pipe.

After a wellbore is drilled, a string of casing is often extended into the wellbore and, once cemented in place, the casing helps support the wellbore from collapse and can serve as a conduit to convey extracted hydrocarbons to the well surface. In some applications, the wellbore is "completed" by introducing a completion string into the well and advancing the completion string past the end of the casing and toward the toe of the wellbore. Completion strings are commonly extended into the wellbore connected to a string of production tubing, which, like the drill string, comprises a plurality of lengths of tubulars connected end-to-end. The completion string can include various downhole tools, such as bridge plugs, sand screens, flow control devices, etc., all used to help extract hydrocarbons from the well.

Similar to the drill string, the completion string can sometimes become stuck within the wellbore either differentially or mechanically, or due to well formation lithology. In such cases, it can require a substantial amount of time and cost to free the completion string.

To prevent the drill pipe or production tubing from sliding against the inner walls of the wellbore or the casing, which can generate significant friction and potentially damage the casing and/or tooling, centralizers are sometimes utilized to center the tubulars within the wellbore. Existing centralizers, however, are themselves in substantial contact with the well casing or wellbore walls, and create friction when rotated. Thus, existing centralizers do not adequately reduce friction.

Accordingly, methods and systems are desired for providing a means of centralizing wellbore tubulars and tools within a wellbore while also reducing friction between the tubulars and tools and the wellbore wall and/or well casing.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a centralizer tool includes a tool body providing opposing first and second ends and defining a central bore extending between the first and second ends. The centralizer tool also includes a plurality of veins provided on an outer surface of the tool body and extending at least partially between the first and second ends, and an interior channel defined in at least one of the plurality of veins and extending between opposing first and second fluid ends of the at least one of the plurality of veins. In addition, the centralizer tool includes at least one roller ball dynamically coupled to and extending radially outward and past an outer surface of the at least one of the plurality of veins, wherein a wellbore fluid circulating through the interior channel is fluidly communicable with the at least one roller ball.

According to another embodiment consistent with the present disclosure, a method of centralizing a wellbore tubular in a wellbore is disclosed. The method may include mounting a centralizer tool on the wellbore tubular, and the centralizer tool may include a tool body providing opposing first and second ends and defining a central bore extending between the first and second ends and sized to extend about an outer circumference of the wellbore tubular, a plurality of veins provided on an outer surface of the tool body and extending at least partially between the first and second ends, an interior channel defined in at least one of the plurality of veins and extending between opposing first and second fluid ends of the at least one of the plurality of veins, and at least one roller ball dynamically coupled to and extending radially outward and past an outer surface of the at least one of the plurality of veins. The method may also include advancing the wellbore tubular and the centralizer tool into the wellbore, and centralizing the wellbore tubular within the wellbore with the centralizer tool, and circulating a wellbore fluid through the interior channel and thereby lubricating and cooling the at least one roller ball.

According to other embodiment consistent with the present disclosure, a centralizer tool includes a tool body providing opposing first and second ends and defining a central bore extending between the first and second ends, a plurality of veins provided on an outer surface of the tool body and extending at least partially between the first and second ends, an interior channel defined in at least one of the plurality of veins and extending between opposing first and second fluid ends of the at least one of the plurality of veins, at least one roller ball dynamically coupled to and extending radially outward and past an outer surface of the at least one of the plurality of veins, and a strainer arranged in an opening provided in at least one of the first and second fluid ends.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
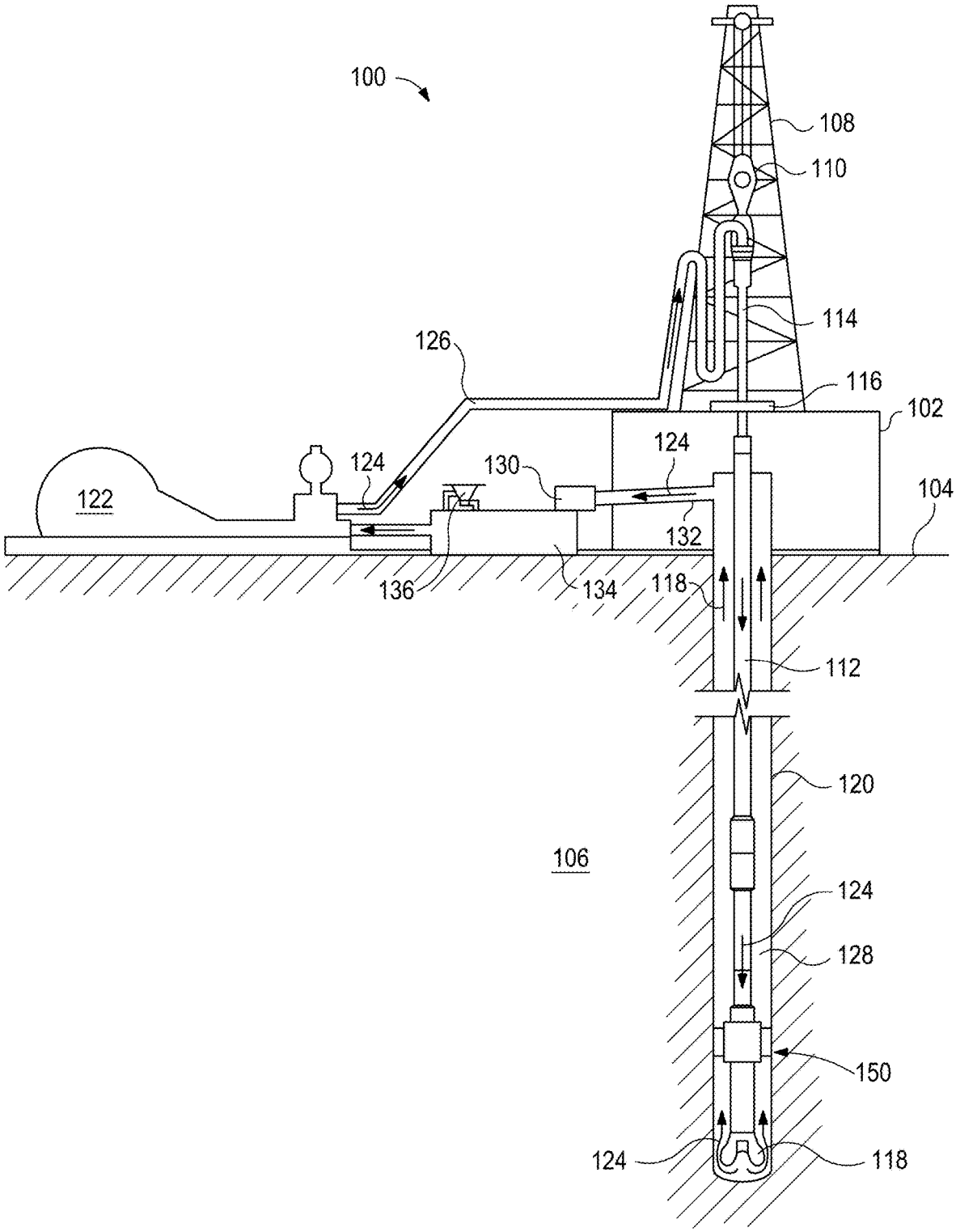
FIG. 1 is a schematic view of an example well system that may employ one or more principles of the present disclosure, according to one or more embodiments of the disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to centering tubulars within a wellbore and, more particularly, to centralizer tools that are operable to both centralize wellbore tubulars within the well and reduce or minimize torque and friction of the tubulars when rotated or advanced along the wellbore. The embodiments disclosed herein include a centralizer tool having a tool body and a plurality of veins extending helically around at least a portion of the tool body, between a top end of the tool body and a bottom end of the tool body. A bore extends through the tool body to enable the centralizer to be mounted to a wellbore tubular, e.g., drill pipe, production tubing, etc. The veins define interior channels and have openings in communication with the interior channels. The centralizer also includes a plurality of rollers dynamically arranged or seated within the veins, and wellbore fluids (e.g., drilling mud, cement, etc.) may enter the interior channels via the openings and thereby lubricate the rollers during operation. The veins with the rollers protruding therefrom provide adequate stand-off between the borehole and the wellbore tubulars, whereas the rollers reduce friction between the borehole and rotating equipment therein, and such reduced friction reduces how much torque needs to be applied to rotate the equipment at the surface.

Referring to FIG. 1, illustrated is an example well system 100 that may employ one or more principles of the present disclosure. More specifically, the well system 100 shown in FIG. 1 comprises a drilling system. It should be noted that while FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent. Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

As illustrated, the well system 100 may include a drilling platform 102 disposed on a surface 104 of the earth 106, e.g., a "well surface". The drilling platform 102 supports a derrick 108 having a traveling block 110 for raising and lowering a drill string 112. The drill string 112 may include a plurality of wellbore tubulars (e.g., drill pipe) connected end-to-end, as generally known to those skilled in the art. A kelly 114 supports the drill string 112 as it is lowered through a rotary table 116. A drill bit 118 is attached to the distal end of the drill string 112 and is driven either by a downhole motor and/or via rotation of the drill string 112 from the well surface. As the bit 118 rotates, it creates a borehole that penetrates various subterranean formations of the earth 106, thus forming a wellbore 120.

A pump 122 (e.g., a mud pump) circulates drilling fluid 124 (i.e., "mud") through a feed pipe 126 and to the kelly 114, which conveys the drilling fluid 124 downhole through the interior of the drill string 112 and through one or more orifices in the drill bit 118. At the drill bit 118, the drilling fluid 124 exits one or more nozzles included in the drill bit 118 and, in the process, cools the drill bit 118 as the bit cuts through the subterranean formations in the earth 106. After exiting the drill bit 118, the drilling fluid 124 circulates back to the surface 104 via the annulus 128 defined between the wellbore 120 and the drill string 112, and in the process returns drill cuttings and debris to the surface 104 and out of the wellbore 120. At the surface, the recirculated or spent drilling fluid 124 exits the annulus 128 and may be conveyed to one or more fluid processing unit(s) 130 via an interconnecting flow line 132. After passing through the fluid processing unit(s) 130, a "cleaned" drilling fluid 124 is deposited into a nearby retention pit 134 (i.e., a mud pit). One or more chemicals, fluids, or additives may be added to the drilling fluid 124 via a mixing hopper 136 communicably coupled to or otherwise in fluid communication with the retention pit 134.

According to embodiments of the present disclosure, one or more centralizing tools 150 (one shown) may be arranged on and otherwise form part of the drill string 112. The centralizing tool 150 (hereinafter, the "centralizer 150") is depicted in FIG. 1 as being arranged near the drill bit 118, but it may alternatively be arranged at other locations along the drill string 112, without departing from the present disclosure. Moreover, while FIG. 1 depicts just one centralizer 150, it is contemplated herein to have a plurality of centralizers 150 spaced (equidistantly or randomly) along the length of the drill string 112.

The centralizer 150 may be secured to the drill string 112 to bear against the inner walls of the wellbore 120 and thereby centralize the drill string 112 and the drill bit 118 in the wellbore 120. As described herein, the centralizer 150 may also operate to reduce frictional forces that may otherwise occur if portions of the drill string 112 and/or the drill bit 118 contact the inner walls of the wellbore 120 when rotating.

Figure 2:
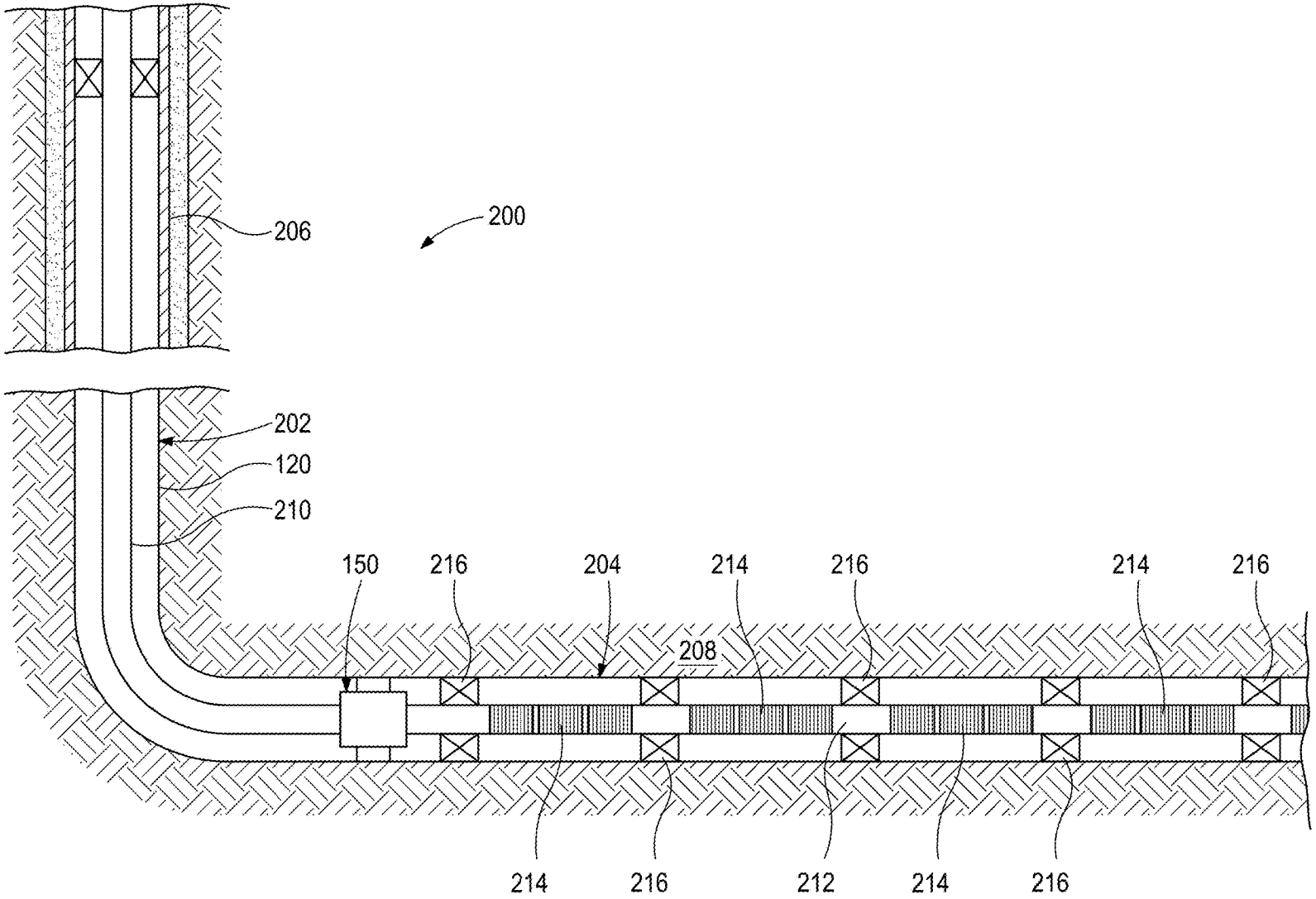
FIG. 2 is schematic view of another example well system that may employ the principles of the present disclosure, according to one or more additional embodiments of the disclosure.

FIG. 2 is another example well system 200 that may employ the principles of the present disclosure, according to one or more embodiments of the disclosure. In some embodiments, the well system 200 may be the same as or similar to the well system 100 of FIG. 1, but further along in the development of the well. As illustrated, for example, the well system 200 includes the wellbore 120 that extends through various earth strata and has a substantially vertical section 202 that transitions into a substantially horizontal section 204. The upper portion of the vertical section 202 may be lined with a string of casing 206 cemented therein to support the wellbore 120, and the horizontal section 204 may extend through one or more hydrocarbon bearing subterranean formations 208. In some applications, the casing 206 may terminate in the vertical section 202, and the horizontal section 204 may comprise an open hole section (extension) of the wellbore 120. In other applications, however, the casing 206 may also extend into the horizontal section 204, without departing from the scope of the disclosure.

A string of production tubing 210 may be positioned within the wellbore 120 and extend from a surface location (e.g., the well surface 104 of FIG. 1). Similar to the drill string 112 of FIG. 1, the production tubing 210 may comprise a plurality of wellbore tubulars (e.g., production tubulars) connected end-to-end, as generally known to those skilled in the art. The production tubing 210 provides a conduit for fluids extracted from the formation 208 to travel to the surface for production.

A completion string 212 may be included at the lower end of the production tubing 210 and arranged within the horizontal section 204. The completion string 212 may divide the wellbore 120 into various production intervals adjacent the subterranean formation 208. As depicted, for example, the completion string 212 may include a plurality of sand control screen assemblies 214 axially offset from each other along portions of the completion string 212. Each sand control screen assembly 214 (hereafter, "screen assembly 214") may be positioned between a pair of wellbore packers 216 that provides a fluid seal between the completion string 212 and the inner walls of the wellbore 120, and thereby defining discrete production intervals. In operation, each screen assembly 214 serves the primary function of filtering particulate matter out of the production fluid stream originating from the formation 208 such that particulates and other fines are not produced to the surface.

While FIG. 1 depicts the screen assemblies 214 as being arranged in a generally horizontal section 204 of the wellbore 120, the screen assemblies 214 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toc of the well.

According to embodiments of the present disclosure, one or more centralizers 150 (one shown) may be arranged on and otherwise form part of one or both of the production tubing 210 and the completion string 214. The centralizer 150 is depicted in FIG. 2 as being arranged on the production tubing 210 and near the completion string 214, but it may alternatively be arranged at other locations along the production tubing 210 or on the completion string 214, without departing from the present disclosure. Moreover, while FIG. 2 depicts just one centralizer 150 in the well system 200, it is contemplated herein to have a plurality of centralizers 150 spaced (equidistantly or randomly) along the length of the production tubing 210 and/or the completion string 214.

Figure 3A:
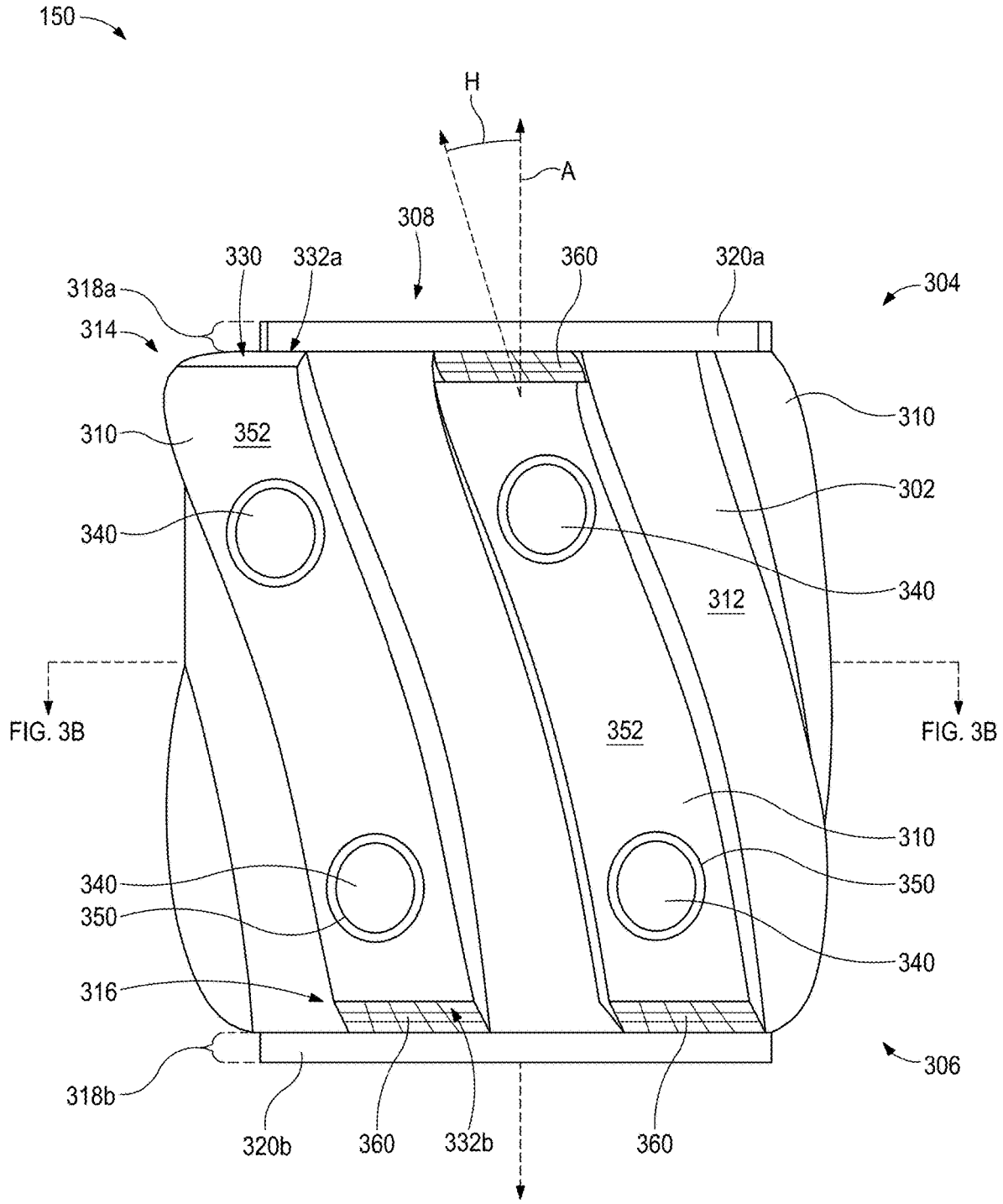
FIG. 3A is a side view of an example of the centralizer tool of FIGS. 1 and 2, according to one or more embodiments of the present disclosure.
Figure 3B:
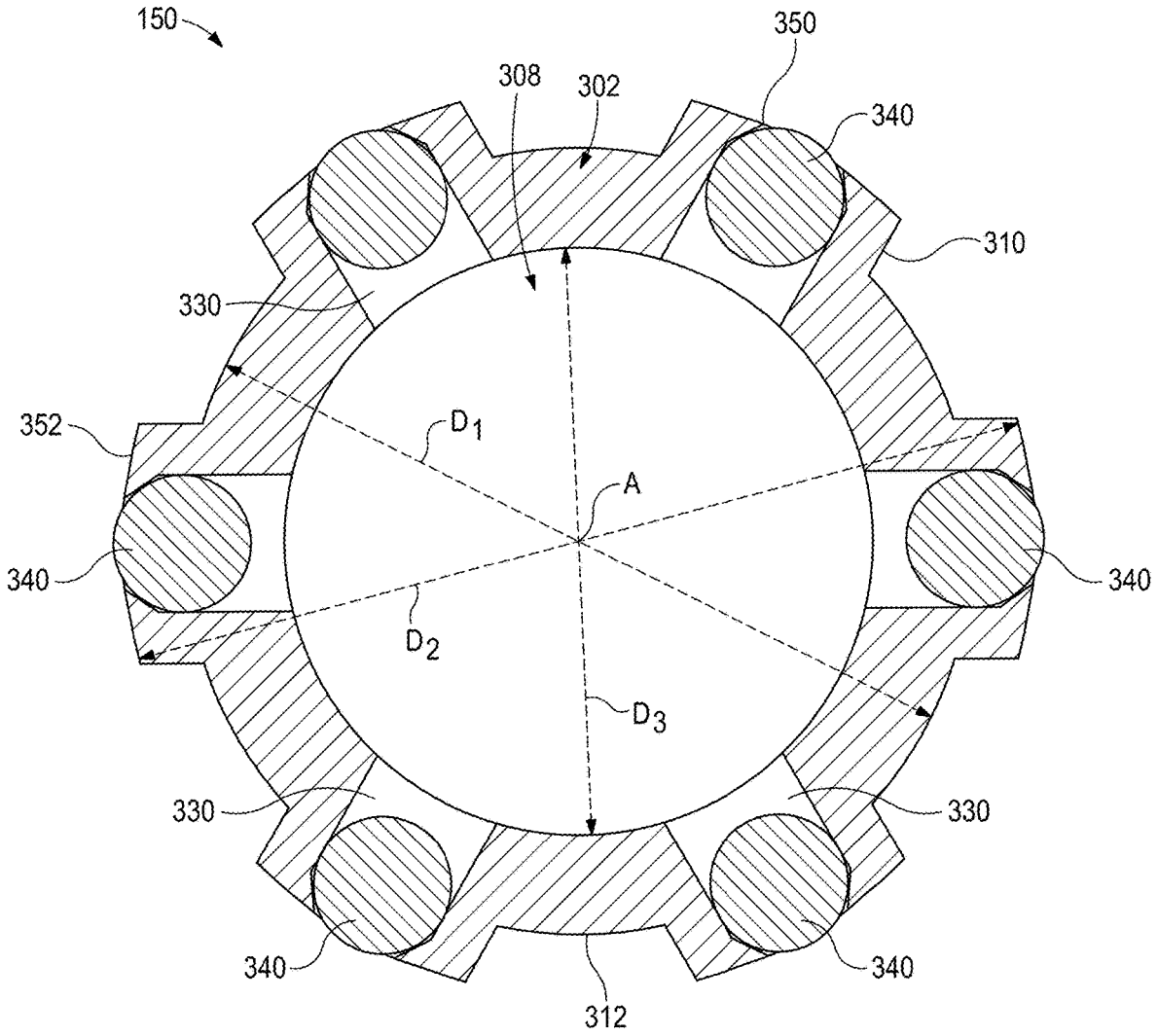
FIG. 3B is cross-sectional top view of the centralizer tool of FIG. 3A.

FIG. 3A is a schematic side view of one example of the centralizer 150 of FIGS. 1 and 2, and FIG. 3B is a cross-sectional top or end view of the centralizer 150 as taken along the section lines 3-3 in FIG. 3A, according to one or more embodiments of the present disclosure. FIGS. 3A-3B depict the centralizer 150 removed from the wellbore tubulars that make up the drill string 112 (FIG. 1) or the production tubing 210 (FIG. 2).

As illustrated, the centralizer 150 includes a generally cylindrical tool body 302 having a first end 304 and a second end 306 opposite the first end 304. A central bore 308 (FIG. 3B) extends through the body 302 along a tool axis A and between the first and second ends 304, 306. As described in more detail below, the central bore 308 may be sized to extend about the outer circumference of a wellbore tubular that makes up a portion of the drill string 112 (FIG. 1) or the production tubing 210 (FIG. 2), or any other type of wellbore tubular known in the art, including casing, coiled tubing, completion components and/or tools (e.g., "completion jewelry), or any combination of the foregoing wellbore tubulars.

As illustrated, the centralizer 150 may provide or otherwise define a plurality of veins 310. The veins 310 protrude from an outer surface 312 of the body 302, radially outward from the tool axis A, and thereby operate to provide a standoff between the wellbore tubular arranged in the central bore 308 of the centralizer 150 and the inner wall of the wellbore 120 (FIGS. 1 and 2).

Referring to FIG. 3B, the body 302 defines a first diameter $D_1$ corresponding to the diameter of the body 302 and measured between opposites sides on the outer surface 312 of the body 302. Moreover, angularly opposite pairs of veins 310 define a second diameter $D_2$, which is greater than the first diameter $D_1$. The bore 308 may define a third diameter $D_3$ that is smaller than the first diameter $D_1$, which accounts for the thickness of the body 302 (i.e., the third diameter $D_3$ is equal to the first diameter $D_1$ minus twice the thickness of the body 302). The third diameter $D_3$ may be sized accordingly to permit mounting of the body 302 on a wellbore tubular forming part of the drill string 112 (FIG. 1) or the production tubing 210 (FIG. 2), or alternatively any other wellbore tubular that may be used in a downhole environment.

In some embodiments, the body 302 and the veins 310 may form integral parts of the centralizer 150. In such embodiments, the veins 310 may be milled or machined into the body 302 and otherwise extend from the body 302, and may made of the same material as the body 302, such as a metal (e.g., stainless steel, aluminum, titanium, etc.), a polymer (e.g., nylon, a high-strength plastic, etc.), a composite material (e.g., tungsten carbide), or any combination thereof. In other embodiments, however, the body 302 and the veins 310 may be separate component parts and made from dissimilar materials. In such embodiments, the veins 310 may be operatively coupled or secured to the outer surface 312 of the body 302 using a variety of fastening means including, but not limited to, welding, brazing, mechanical fasteners, an adhesive, magnets, or any combination thereof. Embodiments in which the veins 310 are operatively coupled to the body 302 may prove advantageous in allowing a user (operator) to replace worn veins 310 as needed without scrapping the entire centralizer 150, and otherwise allowing rehabilitation of the centralizer 150.

As best seen in FIG. 3A, each vein 310 includes opposing first and second fluid ends 314, 316, and the veins 310 may extend between the first and second ends, 304, 306 of the body 302. In other embodiments, one or more of the veins 310 may not extend between the first and second ends 304, 306 of the body 302, but may instead stop short of one or both of the first and second ends 304, 306. The centralizer 150 may include at least one vein 310, but preferably includes two or more veins 310. In FIG. 3B, for example, six veins 310 are depicted, but more or less than six may be employed, without departing from the scope of the disclosure.

In the illustrated embodiment, each vein 310 extends in a generally helical path around (about) the body 302 of the centralizer 150, between the first end 304 and the second end 306. In the depicted embodiment, for example, the each of the veins 310 extends at a helix angle H relative to the tool axis A, from the first end 304 of the body 302, towards the second end 306 of the body 302 while at least partially wrapping around a circumference of the body 302. In this manner, the first and second fluid ends 314, 316 of a particular vein 310 may not be axially aligned. In other embodiments, however, one or more of the veins 310 may wrap about the outer circumference of the body 302 in a full 360° turn such that the first and second fluid ends 314, 316 are axially aligned. In yet other embodiments, one or more of the veins 310 may not be helically wrapped around the body 302, but may instead extend substantially parallel with the tool axis A. In the illustrated embodiment, each of the veins 310 extends helically around the body 302 at the same helix angle H; however, in other embodiments, one or more of the veins 310 may be oriented at a different helix angle H. In embodiments, the helix angle H for each of the veins 310 is constant along the length of the centralizer 150.

In some embodiments, the first fluid end 314 of at least one of the veins 310 is positioned at the first end 304 of the body 302 (i.e., the first end 304 and the first fluid end 314 are arranged at the same axial location along the tool axis A) and the second fluid end 316 of at least one of the veins 310 is positioned at the second end 306 of the body 302 (i.e., the second end 306 and the second fluid end 316 are arranged at the same axial location along the tool axis A). In the illustrated embodiment, however, the first fluid end 314 of each of the veins 310 is axially offset from the first end 304 of the body 302 along the tool axis A, such that an offset distance or gap 318*a* is present between the first end 304 and the first fluid end 314. Similarly, the second fluid end 316 of each of the veins 310 may be axially offset from the second end 306 of the body 302 along the tool axis A, such that an offset distance or gap 318*b* is present between the second end 306 and the second fluid end 316. Thus, in some embodiments, the body 302 may include first and second rim portions 320*a,b* which are defined by gaps 318*a,b*.

In the illustrated embodiment, each of the veins 310 includes or defines an inner flow path or "interior channel" 330, and each vein 310 also defines a pair of openings 332*a,b* that provides fluid communication into the interior channel 330. While the depicted embodiment shows each vein 310 including the interior channel 330, in other embodiments, less than all of the veins 310 may include the interior channel 330. The first opening 332*a* may be positioned at the first fluid end 314 of the vein 310, and the second opening 332*b* may be positioned at the second fluid end 316 of the vein 310, and the interior channel 330 may extend between the openings 332*a,b*. In other embodiments, however, one or both of openings 332*a,b* may be positioned elsewhere on the vein 310 (i.e., at a point intermediate to the first and second fluid ends 314, 316) while being in communication with the interior channel 330.

During example operation of the centralizer 150, a wellbore fluid (e.g., drilling fluid, a spacer fluid, water, cement, a fracking fluid, hydrocarbons, etc.) may circulate through the interior channel 330 by entering one of the openings 332*a,b* and exiting the interior channel 330 via the other opening 332*a,b*. As mentioned below, the wellbore fluid circulating through the interior channels 330 may operate and function as a lubricant for the centralizer 150.

The centralizer 150 further includes a plurality of rollers 340 operatively and dynamically coupled to each vein 310. As used herein, the term "dynamically coupled" refers to a coupled engagement that allows the rollers 340 to roll or spin in place. The rollers 340 operate to reduce friction between the centralizer 150 and the inner walls of the wellbore 120 (FIGS. 1 and 2). In some embodiments, as shown in FIG. 3A, two rollers 340 may be included with each vein 310, with a first roller positioned proximate to the first fluid end 314 of the vein 310 and a second roller positioned proximate to the second fluid end 316 of the vein 310. In other embodiments, however, one or more of the veins 310 may include more or less than two rollers 340, without departing from the scope of the disclosure.

In some embodiments, as illustrated, the rollers 340 may comprise spherical structures, similar to a roller ball or ball bearing. In other embodiments, however, one or more of the rollers 340 may exhibit another geometry such as, but not limited to, a circular cylinder or an ellipsoid. In embodiments, the rollers 340 may be made of a hard or ultra hard material including, but not limited to, stainless steel, titanium, polycrystalline diamond (PDC), tungsten carbide, a ceramic, a high-strength polymer, or any combination thereof. In an embodiment, the rollers 340 are made from a high grade stainless steel with polished surface, so as to reduce friction and provide easy rolling movement.

Each roller 340 may be operatively coupled to and otherwise seated within a corresponding vein 310 such that it protrudes from a hole 350 formed in an outer surface 352 of the vein 310 and is able to rotated or "roll" during operation. As illustrated, the rollers 340 may be arranged in the corresponding hole 350 such that a portion of the rollers 340 extends radially outward and past the outer surface 352 of the corresponding vein 310. In at least one embodiment, each of the holes 350 exhibits a diameter that is at least slightly smaller than a diameter of the roller 340 associated therewith. As best seen in FIG. 3B, each roller 340 is received within a corresponding hole 350 such that it extends partially into the interior channel 330, while a portion of the roller 340 simultaneously protrudes (and is exposed) from the hole 350 radially outward. Thus, the smaller diameter of the hole 350 relative to the roller 340 retains the roller 340 within its seat inside the interior channel 330. The diameter of the hole 350 should be sufficiently sized to hold/retain the roller 340 in place within vein 310 while also allowing the roller 340 to move/roll with the hole 350, which will thereby help the centralizer 150 to move more easily.

During example operation of the centralizer 150, the rollers 340 may be configured to roll or spin when contacting radially adjacent structures, such as the inner wall of the wellbore 120 (FIGS. 1 and 2) or the interior of the casing 206 (FIG. 2). Moreover, as wellbore fluids are circulated within the wellbore 120, the wellbore fluids 120 are able to circulate through the interior channels 330 to help lubricate and cool the rollers 340 as they spin, thereby improving operation of the rollers 340.

In some embodiments, as best seen in FIG. 3A, the centralizer 150 may also include a strainer 360 arranged in any one or more of the pair of openings 332*a,b* formed in the veins 310. The strainer 360 may be sized to cover the opening 332*a,b* of the interior channel 330 and thereby functions to inhibit the flow of particles of a predetermined size, such as cuttings, debris, rock, etc., from entering the interior channels 330. Stated differently, the strainers 360 operate to filter out undesirable particulate matter from entering the interior channels 330, which could otherwise plug the interior channels 330 or damage the rollers 340. In embodiments, the strainer 360 is a wire mesh material. In embodiments, the wire mesh material of the strainer 360 is made from high-grade steel to allow the fluid to pass there-through without allowing debris to pass there-through, such that the strainer 360 is operable to prevent debris from entering the veins 310. In embodiments, each opening 332*a,b* of each vein 310 includes a strainer 360 provided therein. However, in other embodiments, one or more of the openings 332*a,b* may not include a strainer 360. In the illustrated embodiment, for example, one of the veins 310 (e.g., on the left side of the image) does not include a strainer 360 at the upper end 314, thereby exposing the interior channel 330 thereof.

Figure 4:
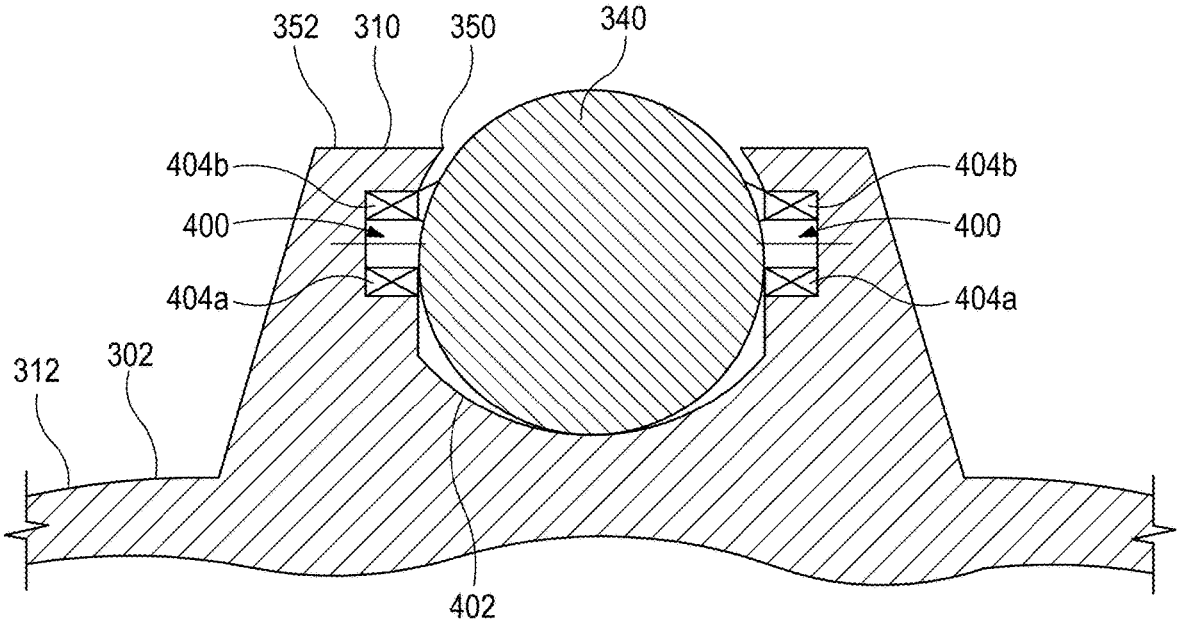
FIG. 4 depicts a cross-sectional view of an example roller arranged within a vein, according to one or more embodiments of the present disclosure.

FIG. 4 is an enlarged, cross-sectional view of an example vein 310 protruding from the body 302, according to one or more embodiments. As illustrated, the vein 310 may exhibit an alternatively configured interior channel 400. In the illustrated embodiment, the roller 340 is seated on a surface 402 defined within interior channel 400, and the surface 402 may be arcuate and otherwise contoured and curved to receive and seat the roller 340. In the illustrated embodiment, the surface 402 is a dimpled/concave/contoured to match the geometry of the roller 340 and thereby provide a seat on which the roller 340 may contact and roll. The interior channel 400 extends the length of the vein 310, between the first end 304 (FIG. 3A) and the second end 306 (FIG. 3A) of the tool body 302, and may further extend helically around the tool body 302 at the helix angle H, but it is not necessary. The interior channel 400 is in communication with the openings 332*a,b* (FIG. 3A) at the upper and lower fluid ends 314, 316 (FIG. 3A) of the vein 310 so as to allow lubricant to flow through the interior channel 400 and thereby lubricate the surface 402 on which the roller 340 is seated. As previously mentioned, the hole 350 in the vein 310 through which a portion of the roller 340 protrudes exhibits a diameter that is smaller than a diameter of the roller 340, such that the roller 340 is constrained within the interior channel 400 on the surface 402 and substantially beneath the hole 350.

In the illustrated embodiment, the roller 340 is retained within the vein 310 via a bearing assembly, which includes a first or "lower" bearing 404*a* and a second or "upper" bearing 404*b*. As shown, the lower bearing 404*a* is provided deeper into the interior channel 400 as compared to the upper bearings 404*b*, and the upper and lower bearings 404*a,b* cooperatively operate to rollingly secure the roller 340 within the interior channel 400. Also, as mentioned above, each of the rollers 340 is constrained within the vein 310 due to the difference in diameter between the hole 350 and the roller 340. During use, lubricant in the form of mud or other drilling fluids enters the interior channels 330 via the openings 332*a,b* and lubricates the rollers 340, as well as the bearings 404*a, b* upon which the rollers 340 are rotatable, thereby improving operation of the rollers 340 and their bearings 404*a, b*.

Also disclosed herein are methods of using the presently described centralizer 150. For example, the centralizer 150 may be secured to the outer circumference of a wellbore tubular forming part of the drill string 112 (FIG. 1) or the production tubing 210 (FIG. 2), or alternatively any other wellbore tubular that may be used in a downhole environment. The method may include mounting the centralizer 150 on the wellbore tubular such that the wellbore tubular extends through the central bore 308 of the body 302 of the centralizer 150. The method may then include advancing and/or inserting the wellbore tubular and the centralizer 150 into the wellbore 120 and centralizing the wellbore tubular within the wellbore 120 via the plurality of veins 310 and the roller 340 that radially extend from the body 302. Further, the method may include circulating a wellbore fluid (i.e., drilling fluid, a spacer fluid, cement, a fracking fluid, hydrocarbons, etc.) through the interior channel 330 and thereby lubricating and cooling the roller 340. As wellbore fluids circulate through the wellbore 120, a portion of the wellbore fluid may enter the interior channel 330 and flow past the rollers 340, thereby lubricating and cooling the rollers 340 as the wellbore tubular and the centralizer 150 are inserted into the wellbore 120. In embodiments, circulating the wellbore fluid through the interior channel 330 further comprises circulating the wellbore fluid from a well surface location (e.g., the well surface 104 of FIG. 1) and through an interior of the wellbore tubular, discharging the wellbore fluid into an annulus defined between the outer circumference of the wellbore tubular and an inner wall of the wellbore 120, circulating the wellbore fluid back to the well surface location within the annulus, and receiving a portion of the wellbore fluid within the interior channel 330 as the wellbore fluid flows back to the well surface location. In embodiment where the strainer 360 is provided in either or both of the openings 332*a,b*, the method may also include inhibiting a flow of particles of a predetermined size included in the wellbore fluid from entering the interior channel 330 with the strainer 360. Moreover, the method may include dynamically mounting the at least one roller 340 in the opening 350 defined int eh vein 310 with one or more bearings 404*a,b*.

Further, the method includes rotating the wellbore tubular, which in turn causes rotation of the centralizer 150 installed thereon, wherein the roller 340 contacts an inner surface of the wellbore 120 to thereby reduce friction. In embodiments, the wellbore tubular and the centralizer 150 may be inserted downward into the wellbore 120 while they are rotated. In embodiments, the method further includes retracting the wellbore tubular and the centralizer 150 upward and outward from the wellbore 120 while they are rotated. The method may also include pumping or injecting a wellbore fluid into the wellbore 120, such that a portion of the wellbore fluid enters the interior channels 330 to lubricate and cool the rollers 340.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A centralizer tool, comprising:

a tool body having opposing first and second body ends and defining a central bore extending between the first and second body ends;

a plurality of veins provided on an outer surface of the tool body and extending at least partially about the outer surface from a first fluid end to a second fluid end between the first and second body ends;

an interior channel defined in at least one of the plurality of veins and extending between a first opening formed in the first fluid end and a second opening formed in the second fluid end, wherein the first and second openings are exterior to the tool body; and at least one roller ball dynamically coupled to and extending radially outward and past an outer surface of the at least one of the plurality of veins, wherein a wellbore fluid circulating through the interior channel is fluidly communicable with the at least one roller ball.

2. The centralizer tool of claim 1, further comprising a strainer arranged in the first opening.

3. The centralizer tool of claim 1, wherein the first fluid end is positioned proximate to the first end of the tool body, and the second fluid end is positioned proximate to the second end of the tool body.

4. The centralizer tool of claim 3, further comprising:

a first strainer arranged in the first opening; and a second strainer arranged in the second opening.

5. The centralizer tool of claim 3, wherein at least one of the first and second fluid ends are axially offset from the first and second body ends of the tool body, respectively, thereby defining a gap between the at least one of the first and second fluid ends and the first and second body ends of the tool body.

6. The centralizer tool of claim 1, wherein the at least one roller ball comprises two or more roller balls dynamically coupled to the at least one of the plurality of veins.

7. The centralizer tool of claim 1, wherein one or more of the plurality of veins extends helically around a portion of the tool body.

8. The centralizer tool of claim 1, wherein at least a portion of the at least one roller ball extends into the interior channel.

9. A method of centralizing a wellbore tubular in a wellbore, comprising:

mounting a centralizer tool on the wellbore tubular, the centralizer tool including:

a tool body defining a central bore sized to extend about an outer circumference of the wellbore tubular;

a plurality of veins provided on an outer surface of the tool body and extending along at least a portion of the outer surface from a first fluid end to a second fluid end;

an interior channel defined in at least one of the plurality of veins and extending between the first and second fluid ends; and at least one roller ball dynamically coupled to and extending radially outward and past an outer surface of the at least one of the plurality of veins, advancing the wellbore tubular and the centralizer tool into the wellbore;

centralizing the wellbore tubular within the wellbore with the centralizer tool;

circulating a wellbore fluid in an annulus around the wellbore tubular through the interior channel and thereby lubricating and cooling the at least one roller ball, wherein the wellbore fluid enters the interior channel through a first opening formed in the first fluid end and exits the interior channel to return to the annulus through a second opening formed in the second fluid end.

10. The method of claim 9, wherein circulating the wellbore fluid through the interior channel comprises:

circulating the wellbore fluid from a well surface location and through an interior of the wellbore tubular;

discharging the wellbore fluid into the annulus, wherein the annulus is defined between the outer circumference of the wellbore tubular and an inner wall of the wellbore;

circulating the wellbore fluid back to the well surface location within the annulus; and receiving a portion of the wellbore fluid within the interior channel as the wellbore fluid flows back to the well surface location.

11. The method of claim 10, wherein the centralizer tool further includes a strainer arranged in a first opening provided in the first fluid end, the method further comprising inhibiting a flow of particles of a predetermined size included in the wellbore fluid from entering the interior channel with the strainer.

12. The method of claim 9, further comprising dynamically mounting the at least one roller ball in a hole defined in the vein with one or more bearings.

13. The method tool of claim 9, wherein the at least one roller ball comprises two or more roller balls dynamically coupled to the at least one of the plurality of veins.

14. The method tool of claim 9, wherein one or more of the plurality of veins extends helically around a portion of the tool body.

15. A centralizer tool, comprising:

a tool body defining a central bore;

a plurality of veins provided on an outer surface of the tool body and extending from a first fluid end to a second fluid end along at least a portion of the outer surface;

an interior channel defined in at least one of the plurality of veins, wherein the interior channel extends from a first opening formed in the first fluid end to a second opening formed in the second fluid end, wherein the first and second openings are exterior to the tool body;

at least one roller ball dynamically coupled to and extending radially outward and past an outer surface of the at least one of the plurality of veins; and a strainer arranged in the first opening.

16. The centralizer tool of claim 15, wherein the strainer is a first strainer, and further comprising a second strainer arranged in the second opening.

17. The centralizer tool of claim 15, wherein the at least one roller ball comprises two or more roller balls dynamically coupled to at least one of the plurality of veins.

18. The centralizer tool of claim 15, wherein one or more of the plurality of veins extends helically around a portion of the outer surface of the tool body.

19. The method of claim 9, filtering the fluid flowing into the opening formed in the first fluid end with a strainer arranged in the first opening.

* * * * *